US006837442B2

(12) United States Patent
Kobayashi et al.

(10) Patent No.: US 6,837,442 B2
(45) Date of Patent: Jan. 4, 2005

(54) EXPANSION VALVE

(75) Inventors: Kazuto Kobayashi, Tokyo (JP); Masamichi Yano, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 221 days.

(21) Appl. No.: 10/165,312

(22) Filed: Jun. 10, 2002

(65) Prior Publication Data

US 2002/0185621 A1 Dec. 12, 2002

(30) Foreign Application Priority Data

Jun. 12, 2001 (JP) ..... 2001-176912

(51) Int. Cl.[7] ..... F25B 41/06

(52) U.S. Cl. ..... 236/92 B; 137/15.19; 137/315.27; 403/350

(58) Field of Search ..... 137/315.27, 15.19; 251/61.3; 236/92 B; 403/350, 353

(56) References Cited

U.S. PATENT DOCUMENTS 1,945,760 A * 2/1934 Stouf
5,547,126 A 8/1996 Bogrand, IV et al.
5,549,228 A * 8/1996 Brown ..... 222/570
6,012,301 A * 1/2000 Fujimoto et al. ..... 236/92 B
6,302,617 B1 * 10/2001 Rumpp ..... 403/348

FOREIGN PATENT DOCUMENTS

| | | |
|---|---|---|
| EP | 0537776 A1 | 4/1993 |
| EP | 0836061 A1 | 4/1998 |
| JP | 2000-97522 | 4/2000 |

OTHER PUBLICATIONS

European Search Report dated Nov. 21, 2003.

* cited by examiner

*Primary Examiner*—Harry B. Tanner
(74) *Attorney, Agent, or Firm*—Rader, Fishman & Grauer PLLC

(57) ABSTRACT

An expansion valve 1 comprises a square-column-shaped valve body 10, and a spherical valve means 30 housed within a valve chamber 20 opposing against a valve seat 22. A working shaft 50 coming into contact with said valves means 30 connects to a stopper member 60, thereby transmitting to the valve means 30 the movement of a diaphragm 230 being displaced by the pressure change in a pressure chamber 240 of a power element 200. A lower housing 220 of the power element 200 is provided with an opening portion and claws, which enable the power element to be coupled to a mounting unit 100 formed to the top portion of the valve body 10. An elastic packing member 150 enables the element to be securely and airtightly coupled to the body. According to the present invention, the assembling of the valve is simplified and the manufacturing cost is reduced.

8 Claims, 8 Drawing Sheets

(a)

(b)

(a)

(b)

EXPANSION VALVE

FIELD OF THE INVENTION

The present invention relates to an expansion valve for a refrigerant used in a refrigeration cycle of an air conditioner or a refrigeration device and the like.

DESCRIPTION OF THE RELATED ART

The conventional expansion valve of the present type is disclosed for example in Japanese Patent Laid-Open Provisional Publication No. 2000-97522 filed by the present applicant, wherein a member called a power element that stores a pressure chamber filled with working gas is coupled to a valve body made of aluminum alloy etc., the displacement of the diaphragm operated by the pressure of the working gas filled inside the pressure chamber being transmitted to a valve means thereby controlling the flow of the refrigerant.

In the above-mentioned type of expansion valves, a screw mechanism is used for coupling the power element and the valve body.

However, according to the screw mechanism, it is necessary to provide screw threads to both members being coupled, and upon coupling the two members, the power element must be rotated until it reaches the end of the screw thread in order to complete the coupling process. At the same time, measures for preventing refrigerant gas from leaking must be provided to the screw coupling portion.

SUMMARY OF THE INVENTION

Therefore, the present invention aims at providing an expansion valve that enables the power element to be coupled to the valve body by a simple operation.

The expansion valve according to the present invention comprises a first passage through which refrigerant traveling from a compressor toward an evaporator travels, a second passage through which refrigerant returning from the evaporator toward the compressor travels, a valve body including a valve chamber formed in the middle of the first passage and housing a valve means, and a power element having a driving function for operating the valve means, wherein a coupling means for coupling the valve body and the power element comprises a cylindrical portion mounted to the top portion of the valve body, plural projections protruding from the cylindrical portion toward the outer circumferential direction, and plural claws formed to the housing of the power element designed to engage with the projections formed to the valve body.

Further, the coupling means for coupling the valve body and the power element comprises a ring-shaped groove formed to the top portion of the valve body, plural projections protruding from the ring-shaped groove toward the inner circumferential direction, and plural claws formed to the housing of the power element designed to engage with the projections formed to the valve body.

The coupling means for coupling the valve body and the power element is equipped with two projections and two claws which are disposed at 180 degree intervals.

According to another example, the coupling means for coupling the valve body and the power element can be equipped with three projections and three claws which are disposed at 120 degree intervals, or with four projections and four claws which are disposed at 90 degree intervals.

Furthermore, the expansion valve comprises a packing member formed of an elastic material, which is mounted to the top portion of the valve body and pressed by the power element.

DETAILED DESCRIPTION OF THE PREFERRED EMBODIMENT

Figure 1:
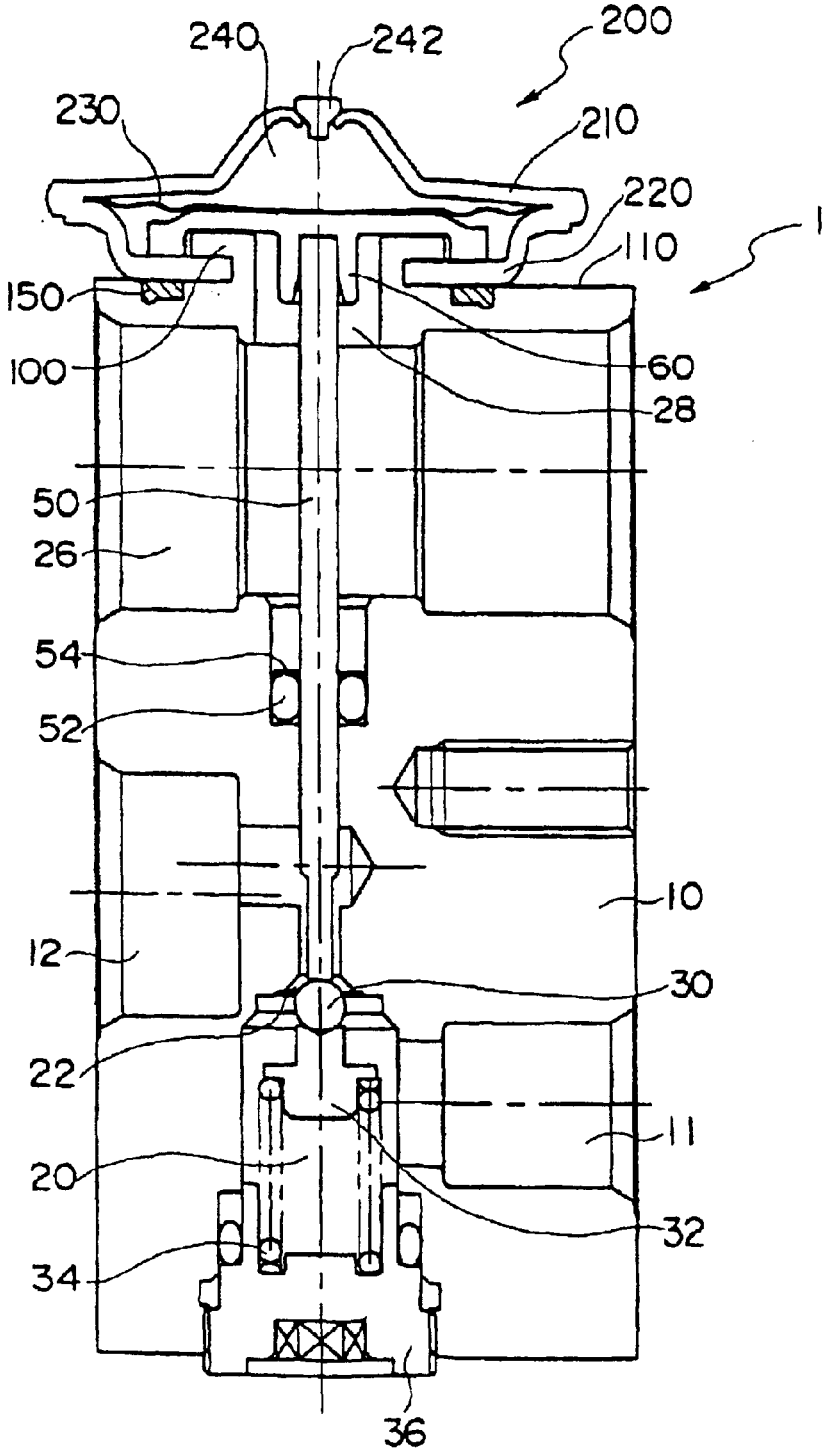
FIG. 1 is a cross-sectional view of the expansion valve according to the present invention.

FIG. 1 is a cross-sectional view showing one preferred embodiment of the expansion valve according to the present invention.

An expansion valve denoted as a whole by reference number 1 comprises a square column shaped valve body 10 formed for example of aluminum alloy.

The valve body 10 includes first passages 11 and 12 through which passes the refrigerant traveling from a condenser and a receiver toward an evaporator constituting the refrigerant cycle not shown, with a valve chamber 20 formed in the middle of the first passages 11, 12. The valve chamber 20 is equipped with a valve seat constituting an orifice 22 that communicates the passage 11 with passage 12, and a spherical valve means 30 is supported by a valve member 32 so as to oppose to the valve seat. The valve means 32 is supported via a pressure spring 34 by a pressure regulating screw 36, and by adjusting the screwing of the pressure regulating screw 36 toward the valve chamber 20, the pressing force of the valve means 30 toward the orifice is regulated.

The valve body 10 is provided with a second passage 26 through which refrigerant flowing from an evaporator to a compressor not shown travels.

An opening 28 is formed along the longitudinal axis of the valve body 10 orthogonal to the second passage 26, and the circumference of the opening 28 on the upper surface 110 on the top of valve body 10 is formed amounting portion 100 for mounting a power element 200.

The power element 200 comprises an upper housing 210 and a lower housing 220, which are welded together at their periphery to create an integral housing structure, and a diaphragm 230 sandwiched between the upper and lower housings.

A pressure chamber 240 is defined between the diaphragm 230 and the upper housing 210, which is filled with working gas and sealed with a plug 242.

A stopper member 60 is disposed between the diaphragm 230 and the lower housing 220, and the stopper member 60 transmits the displacement of the diaphragm 230 to the valve means 30 through a working rod 50.

A seal ring 52 is mounted via a snap ring 54 to the outer side of the working rod 50 in the valve body 10, thereby sealing the refrigerant.

According to the present expansion valve, the power element 200 can be assembled to the mounting portion 100 of the valve body 10 through a simple mounting operation.

Figure 2:
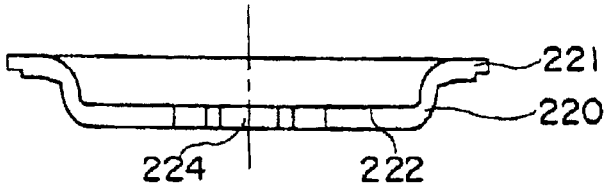
FIG. 2 is a cross-sectional view showing the structure of the power element.
Figure 3:
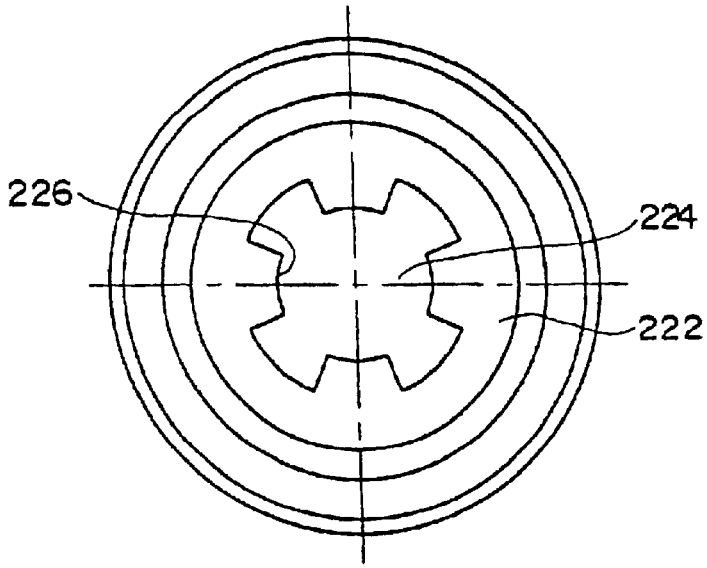
FIG. 3 is a plan view showing the structure of the power element.
Figure 4:
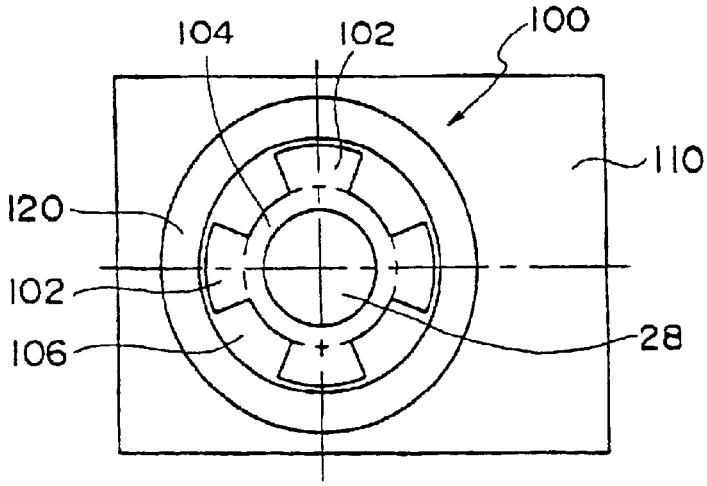
FIG. 4 is a plan view showing the structure of the power element.
Figure 5:
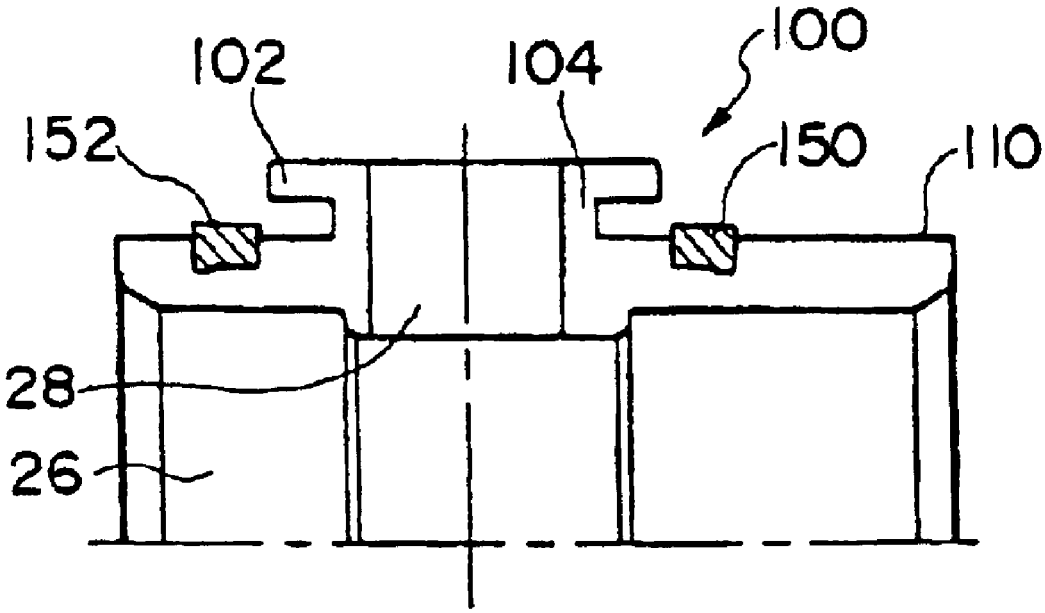
FIG. 5 is a cross-sectional view showing the upper portion of the expansion valve body.

FIG. 2 is a cross-sectional view of the lower housing 220, FIG. 3 is a plan view thereof, FIG. 4 is a plan view of the valve body, and FIG. 5 is a cross-sectional view thereof.

The lower housing 220 comprises a joint portion 221 to be bonded to the upper housing 210, and a flat portion 222, with an opening 224 formed to the center area thereof. A plurality of claws 226 extending toward the center of the opening 224 is formed to the inner circumference of the flat portion 222.

On the other hand, a mounting portion 100 that protrudes from the upper surface 110 of the valve body is provided to the top portion of the valve body 10.

The mounting portion 100 includes a cylindrical portion 104 and plural projections 102 that protrude outward from the cylindrical portion 104. Spaces 106 are formed between the neighboring projections 102 through which the claws 226 of the lower housing 220 of the power element 200 can pass.

On the upper surface 110 of the valve body is created a ring-shaped packing groove 120, to which is inserted a ring-shaped packing member 150.

The packing member 150 is made of an elastic material and designed to protrude above the upper surface 110 of the valve body when in a free condition.

When assembling the power element 200 to the valve body 10, a power element 200 is assembled and completed at first, having the diaphragm 230 and the stopper member 60 equipped to the interior thereof and filled with working gas. Then, the lower housing 220 is positioned so as to come into contact with the upper surface 110 of the valve body so that the claws 226 of the lower housing 220 of the power element 200 pass through the spaces 106 formed to the mounting portion 100 of the valve body 10. Then, while compressing the packing member 150, the power element 200 is twisted around the axis. Through this movement, the claws 226 of the power element come into contact with the lower surface of the projections 102 at the mounting portion 100 of the valve body. By releasing the force pressing the power element 200, the claws 226 are pressed against the projections 102 by the elasticity of the packing member 150, and the power element 200 is thereby securely fixed to the mounting portion 100 of the valve body.

According to the present expansion valve, the power element can be mounted to the valve body by a simple operation. Therefore, the number of steps required to assemble the power element to the valve body can be minimized.

Figure 6:
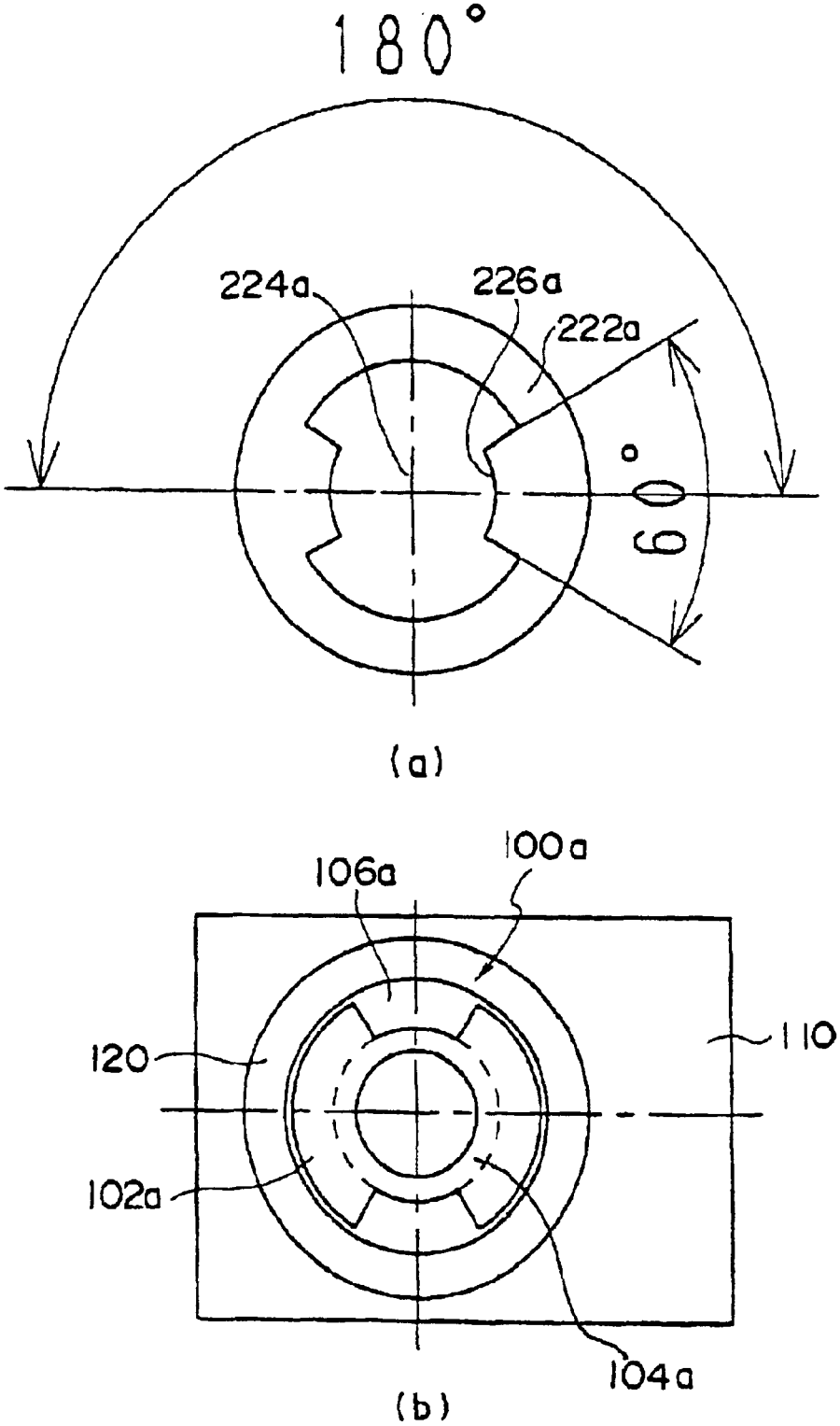
FIG. 6 is an explanatory view showing the structure of the coupling means.

FIG. 6 shows another mounting structure of the expansion valve according to the present invention, wherein (a) is a planar structure of the power element, and (b) is the planar structure of the valve body.

The lower housing of the power element comprises a flat portion 222*a* and an opening 224*a*, the opening 224*a* formed to the center area of the flat portion 222*a*. Further, two claws 226*a* that protrude toward the opening 224*a* are formed thereto which are spaced apart by 180 degrees. Moreover, the angle that the side edges of each fan-shaped claw 226*a* create is, for example, approximately 60 degrees.

On the other hand, the mounting portion 100*a* formed to the upper surface 110 of the valve body comprises a cylindrical portion 104*a* and two projections 102*a* that protrude outward therefrom. Spaces 106*a* are created between the two projections 102*a*.

Upon mounting the power element to the valve body, the power element is inserted to the upper surface 110 of the valve body in the position where the claws 226*a* on the lower housing of the power element do not interfere with the projections 102*a* on the mounting portion of the valve body. Thereafter, the power element is rotated until the claws 226*a* of the power element come into contact with the back surface of the projections 102*a* of the valve body.

The structure for fitting the packing member to the groove 120 formed to the upper surface 110 of the valve body is similar to the first embodiment.

Figure 7:
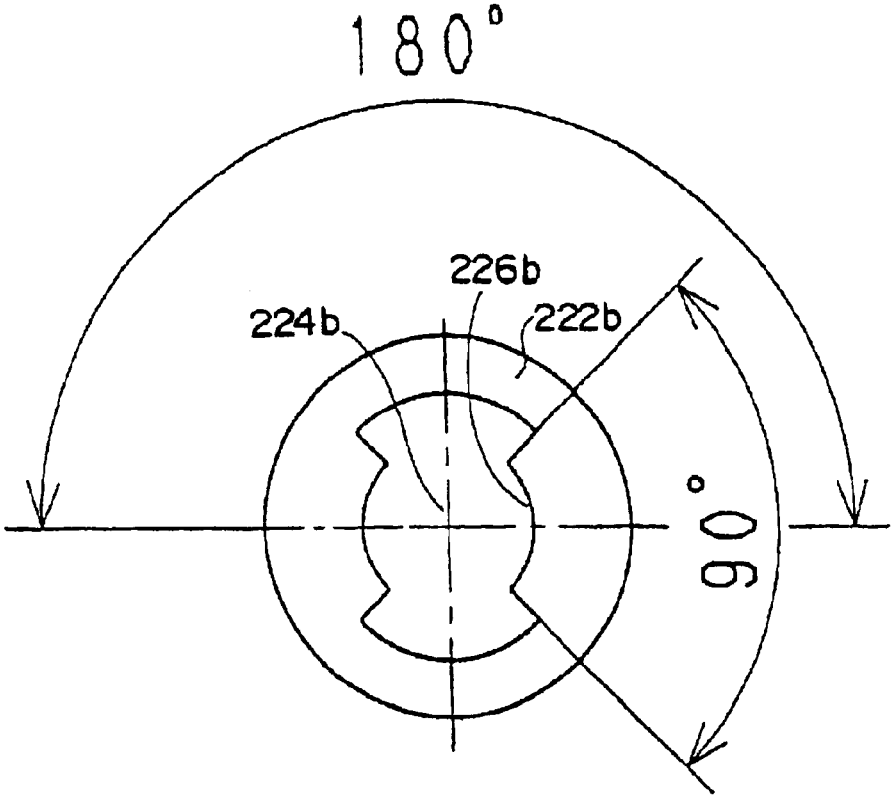
FIG. 7 is an explanatory view showing the structure of the coupling means.
Figure 7:
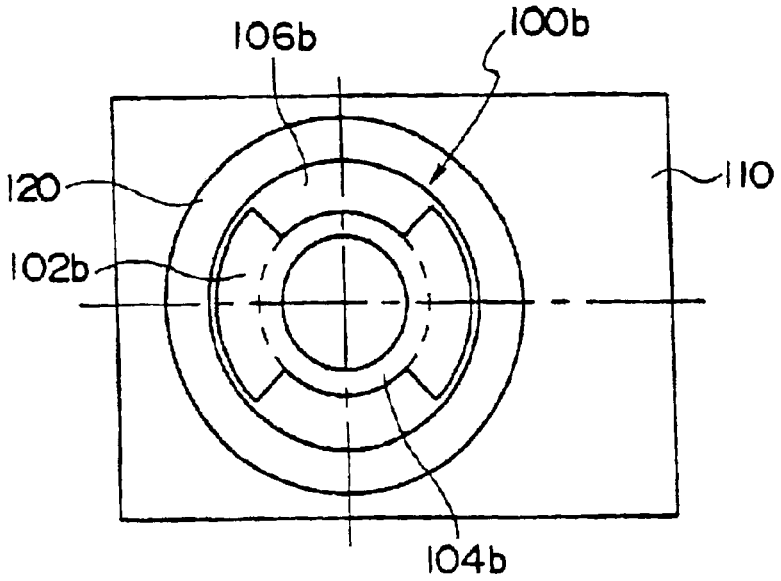

FIG. 7 shows yet another example of the mounting mechanism.

The lower housing of the power element comprises a flat portion 222*b* and an opening 224*b*, the opening 224*b* provided to the center area of the flat portion 222*b*, further comprising two fan-shaped claws 226*b* formed to protrude toward the opening 224*b*. The angle of opening of the claws 226*b* is, for example, approximately 90 degrees.

A mounting portion 100*b* is equipped to the upper surface 110 of the valve body. The mounting portion 100*b* comprises a cylindrical portion 104*b* and two projections 102*b* that protrude outward from the cylindrical portion 104*b*.

Upon mounting the power element to the valve body, the claws 226*b* on the power element are inserted through the spaces 106*b* formed to the valve body, and the power element is rotate until the claws 226*b* come into contact with the projections 102*b*.

Figure 8:
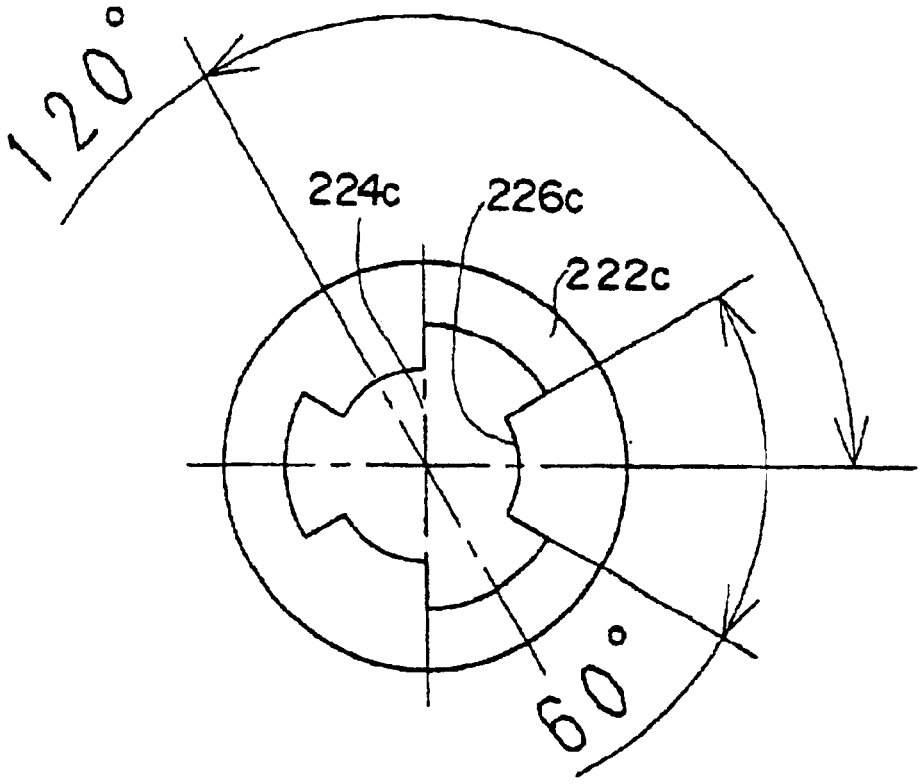
FIG. 8 is an explanatory view showing the structure of the coupling means.
Figure 8:
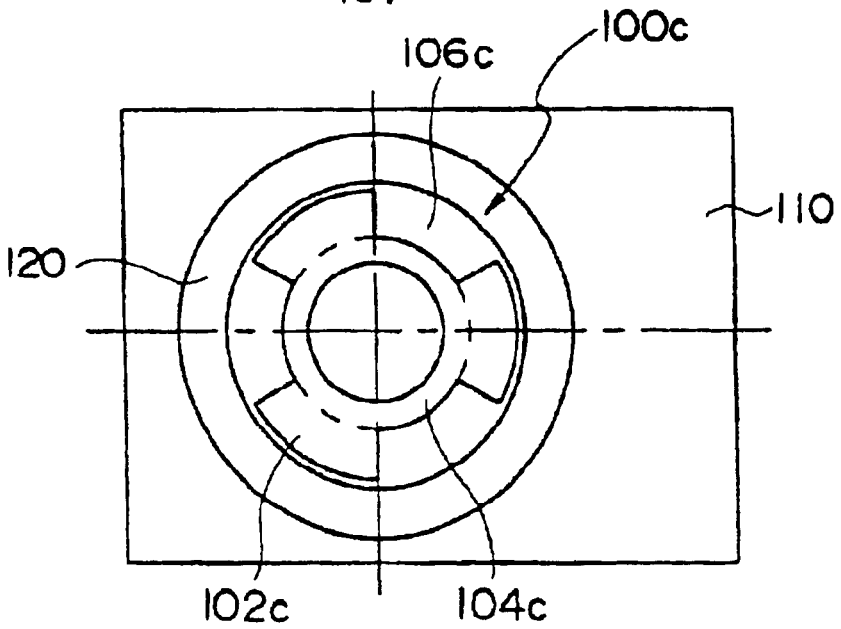

FIG. 8 shows yet another example of the mounting mechanism.

The lower housing of the power element comprises a flat portion 222*c* and an opening 224*c*, the opening 224*c* formed to the center of the flat portion 222*c*, with three claws 226*c* that are disposed at 120 degree intervals. The angle of opening of each fan-shaped claw 226*c* is, for example, approximately 60 degrees.

A mounting portion 100*c* is provided to the upper surface 110 of the valve body. The mounting portion 100*c* includes a cylindrical portion 104*c* and three projections 102*c* that protrude from the outer periphery of the cylindrical portion.

Upon mounting the power element to the valve body, the claws 226*c* on the power element is inserted through the spaces 106*c* on the valve body, and the power element is rotated until the claws 226*c* come into contact with the projections 102*c*.

All the above-mentioned examples include a packing member inserted to the groove 120 on the upper surface 110 of the valve body.

Figure 9:
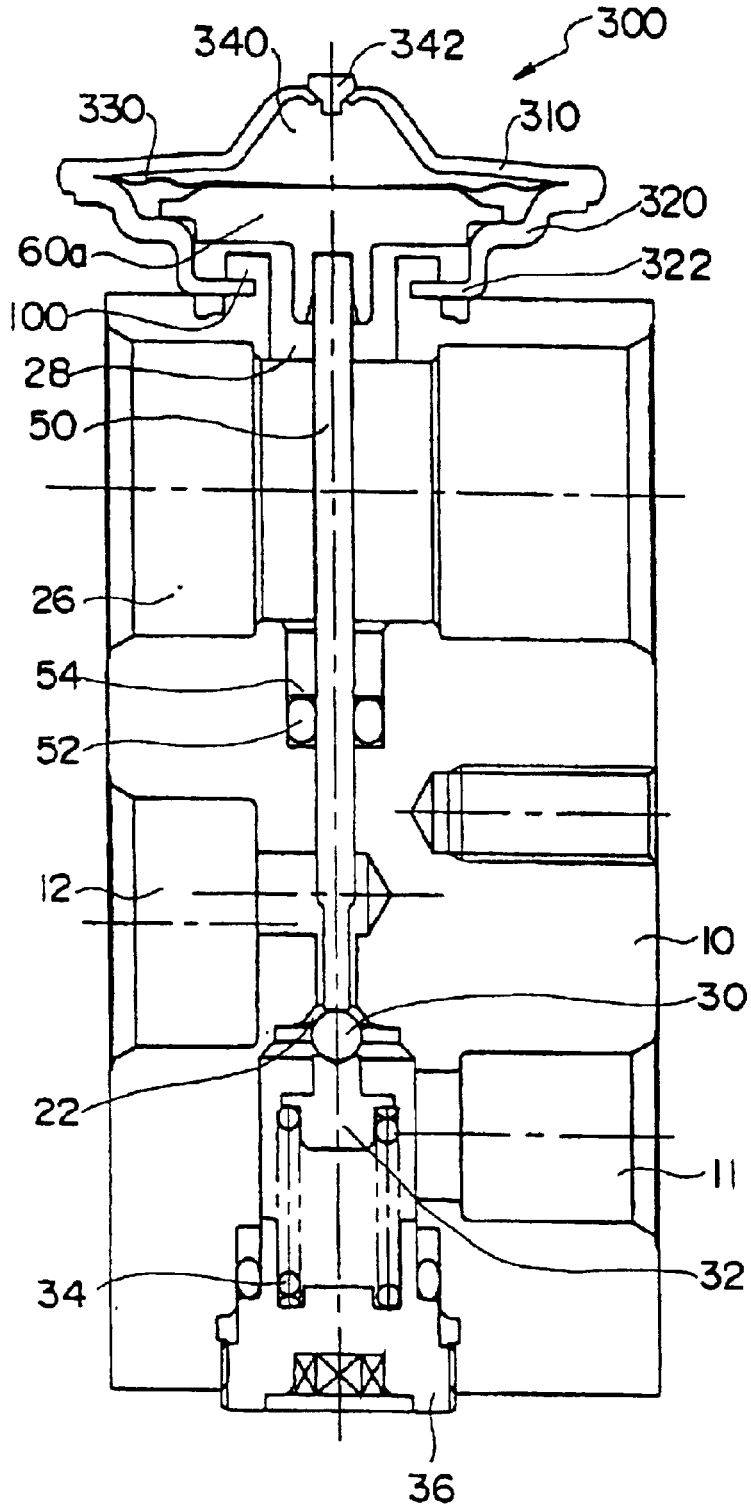
FIG. 9 is a cross-sectional view showing another example of the expansion valve according to the present invention.

FIG. 9 is a cross-sectional view showing another embodiment of the present invention.

The structure of the expansion valve is similar to the one explained previously, so the components are provided with the same reference numbers and detailed descriptions thereof are omitted.

The structure of the mounting unit 100 provided to the top of the valve body 10 is also similar to the one explained previously.

The power element 300 comprises an upper housing 310, a lower housing 320, and a diaphragm 330 that defines a pressure chamber 340. A working gas is filled in the pressure chamber 340, which is sealed by a plug 342.

The lower housing 320 comprises two step portions, and is connected to the mounting unit of the valve body. The mounting mechanism is the same as those explained previously. In the present example, the thickness of the stopper member 60*a* is increased to correspond to the size of the lower housing 320.

Figure 10:
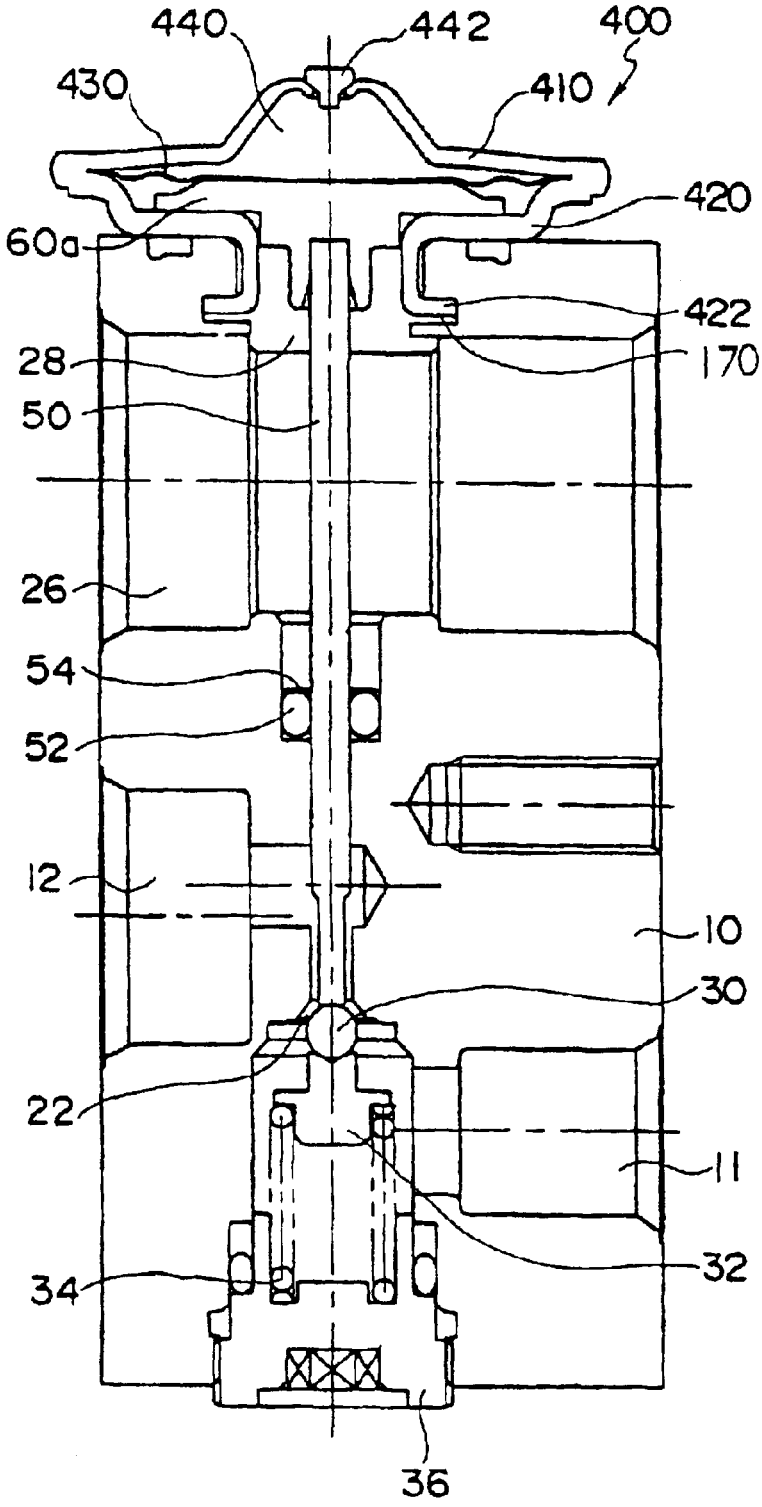
FIG. 10 is across-sectional view showing yet another example of the expansion valve according to the present invention.

FIG. 10 is a cross-sectional view showing yet another embodiment of the present invention.

The structure of the expansion valve is the same as the ones explained previously, so the same components are provided with the same reference numbers and detailed descriptions thereof are omitted.

The structure of the mounting unit 170 equipped to the top of the valve body 10 comprises a ring-shaped groove having a slit formed along the axial direction of the valve body.

The power element 400 comprises an upper housing 410, a lower housing 420, and a diaphragm 430 that defines a pressure chamber 440. The pressure chamber 440 is filled with working gas and sealed by a plug 442.

A collar 422 spreading outward is formed to the end of the lower housing 420, which is inserted to the slit formed to the valve body 10, and the power element 400 is connected to the valve body 10 by rotating the element 400. The shape of the collar 422 and the mounting groove 170 of the valve body are similar to those explained previously.

As explained, the present invention enables the power element to be assembled to the expansion valve body by a simple operation, so the manufacturing procedure of the expansion valve is effectively simplified.

Even further, the present invention provides a secure sealing structure for sealing the refrigerant gas.

What is claimed is:

1. An expansion valve comprising:

a first passage through which refrigerant traveling from a compressor toward an evaporator travels;

a second passage through which refrigerant returning from the evaporator toward the compressor travels;

a valve body including a valve chamber formed in the middle of the first passage and housing a valve means;

a power element having a driving function for operating the valve means; and a coupling means for coupling the valve body and the power element, comprising a cylindrical portion mounted to the top portion of the valve body, plural projections protruding from the cylindrical portion toward the outer circumferential direction, and plural claws formed to the housing of the power element designed to engage with the projections formed to the valve body.

2. An expansion valve comprising:

a first passage through which refrigerant traveling from a compressor toward an evaporator travels;

a second passage through which refrigerant returning from the evaporator toward the compressor travels;

a valve body having a top portion and including a valve chamber formed in the middle of the first passage and housing a valve means;

a power element having a driving function for operating the valve means; and a coupling means for coupling the valve body and the power element, comprising a ring-shaped groove formed to the top portion of the valve body, plural projections protruding from a cylindrical portion disposed on the top portion of the valve body and directed toward an inner circumferential portion of the ring-shaped groove, and plural claws formed to the housing of the power element designed to engage with the projections formed to the valve body.

3. An expansion valve according to claim 1 or claim 2, wherein the coupling means for coupling the valve body and the power element is equipped with two projections and two claws which are disposed at 180 degree intervals.

4. An expansion valve according to claim 1 or claim 2, wherein the coupling means for coupling the valve body and the power element is equipped with three projections and three claws which are disposed at 120 degree intervals.

5. An expansion valve according to claim 1 or claim 2, wherein the coupling means for coupling the valve body and the power element is equipped with four projections and four claws which are disposed at 90 degree intervals.

6. An expansion valve according to claim 1 or claim 2, further comprising a packing member formed of an elastic material which is mounted to the top portion of the valve body and pressed by the power element.

7. An expansion valve according to claim 1 or claim 2, further comprising a ring-shaped packing member formed of an elastic material and disposed to surround the cylindrical portion and the plural projections.

8. An expansion valve according to claim 7, wherein the ring-shaped packing member simultaneously contacts the top portion of valve body and the power element when plural projections and plural claws are engaged with each other.

* * * * *